US005213662A

United States Patent [19]

Henricson

[11] Patent Number: 5,213,662

[45] Date of Patent: May 25, 1993

[54] TREATMENT OF CHIPS WITH HIGH TEMPERATURE BLACK LIQUOR TO REDUCE BLACK LIQUOR VISCOSITY

[75] Inventor: Kaj Henricson, Kotka, Finland

[73] Assignee: Kamyr, Inc., Glens Falls, N.Y.

[21] Appl. No.: 744,506

[22] Filed: Aug. 14, 1991

[51] Int. Cl.[5] ..... D21C 3/26

[52] U.S. Cl. ..... 162/19; 162/37; 162/68; 162/39

[58] Field of Search ..... 162/37, 19, 38, 39, 162/250, 68, 52, 246, 46, 47

[56] References Cited

U.S. PATENT DOCUMENTS

| | | | |
|---|---|---|---|
| 3,578,554 | 9/1968 | Richter | 162/246 |
| 3,849,247 | 11/1974 | Richter | 162/52 |
| 4,929,307 | 5/1990 | Kiiskila et al. | 159/47.3 |
| 4,953,607 | 9/1990 | Erkki et al. | 159/13.3 |
| 5,080,755 | 1/1992 | Backlund | 162/19 |

FOREIGN PATENT DOCUMENTS 407370 1/1991 European Pat. Off. .

OTHER PUBLICATIONS

Svensk Papperstidning Nr. 5, 1991, pp. 24–29; Hiljanen et al.

Ryham, "High Solids Evaporation Through Thermal Depolymerization of Black Liquor", 1989 Chemical Recovery, pp. 157–160.

*Primary Examiner*—W. Gary Jones
*Assistant Examiner*—Dean Nguyen
*Attorney, Agent, or Firm*—Nixon & Vanderhye

[57] ABSTRACT

A method and apparatus provide for the production of low kappa number (e.g. below 20) kraft paper pulp, and a low viscosity black liquor which is easily transported to a recovery or disposal stage. Comminuted cellulosic fibrous material is steamed, passed to a treatment vessel, and then introduced into the top of a continuous digester. Black liquor is withdrawn from the digester and heated about 20–40 degrees C. above cooking temperature (e.g. about 170 degrees C.), and then introduced into contact with the material in the treatment vessel. After the material is treated with the black liquor, it is withdrawn from the treatment vessel, and passed to the recovery or disposal stage. White liquor may be introduced into the treatment vessel after black liquor withdrawal, after passing in heat exchange relationship with liquid recirculated from an impregnation vessel to a high pressure feeder. Alkali may be added to the black liquor withdrawn from the digester, prior to heating, and after heating it may be passed to a reaction vessel.

29 Claims, 3 Drawing Sheets

TREATMENT OF CHIPS WITH HIGH TEMPERATURE BLACK LIQUOR TO REDUCE BLACK LIQUOR VISCOSITY

BACKGROUND AND SUMMARY OF THE INVENTION

In the production of kraft pulp, black liquor is a common waste liquor. The black liquor must be passed to a recovery stage (that is have the chemicals therefrom recovered), or disposed of, and to facilitate either of these options, it is desirable that the black liquor have a low viscosity. Typical black liquor has a high viscosity, however. It is known per se that the viscosity of black liquor will decrease if it is heated under certain circumstances, however this fact has not heretofore resulted in practical application in a pulp mill for the continuous production of kraft pulp.

According to the present invention, the black liquor removed from the processing of comminuted cellulosic fibrous material into kraft paper pulp is acted upon in such a way that it has a lower viscosity than is conventional, and additionally it adds sulphur compounds to the cellulose material so that the pulp produced will have a lower kappa number than if treated conventionally (e.g. a kappa number of lower than 20). By heating the black liquor above cooking temperature (e.g. to about 200 degrees C.) after it is withdrawn from a continuous digester, and then recirculating it to a point prior to where the material is fed to a continuous digester, sulphur therefrom mixes with the material. The black liquor is then withdrawn from contact with the material, and fed to a recovery or disposal stage, the black liquor having a lower viscosity than when just withdrawn from the digester.

According to one aspect of the present invention, a method of producing kraft pulp from comminuted cellulosic fibrous material, using a continuous digester, is provided. The method comprises the steps of continuously: (a) steaming the comminuted cellulosic fibrous material; (b) adding white liquor to the steamed material; (c) cooking the material, with white liquor, in the continuous digester at a cooking temperature; (d) extracting black liquor from the continuous digester; (e) heating the extracted black liquor above the cooking temperature; (f) adding the heated black liquor from step (e) to the steamed material between steps (a) and (b); and (g) withdrawing the black liquor from the material between steps (f) and (b). Step (c) is typically practiced at a temperature of approximately 170 degrees C., in which case step (e) is practiced to heat the black liquor to a temperature of about 200 degrees C. (e.g. about 20–40 degrees C. over the cooking temperature).

The method of the present invention also may comprise the further step (h), between steps (e) and (f), of maintaining the material at above cooking temperature a time sufficient to insure significant reduction of the viscosity thereof. Step (h) may be practiced in a reaction vessel, and alkali may be added to the black liquor prior to, or simultaneously with, heating thereof. The black liquor withdrawn in step (g) is passed to a recovery or disposal stage, and steps (a)–(g) are practiced so that the black liquor at this stage has a significantly lower viscosity than the black liquor withdrawn in step (d). The white liquor may also be passed in heat exchange relationship with recirculating liquid prior to a high pressure feeder, to cool the recirculating liquid and heat the white liquor.

The invention also contemplates an apparatus for treating comminuted cellulosic fibrous material to produce kraft pulp, comprising a steaming vessel; a generally upright treatment vessel operatively connected to the steaming vessel; an upright continuous digester, operatively connected to the treatment vessel, the digester having a material inlet at the top thereof, and a material outlet at the bottom thereof; withdrawal screen means located at an intermediate portion of the digester, between the inlet and outlet thereof, for withdrawing black liquor from the digester into a withdrawal conduit; heating means for heating the withdrawn black liquor in the withdrawal means; recirculating means for recirculating the heated withdrawn black liquor to the treatment vessel at a first point thereof; and withdrawal means for withdrawing black liquor from the treatment vessel at a second point thereof, vertically spaced from the first point.

The apparatus may further comprise means for adding white liquor to the treatment vessel at a third point, closer to the digester than the second point. There also may be means for adding alkali to the digester black liquor withdrawal conduit before the heating means, and a reaction vessel for maintaining the heated black liquor at elevated temperature, between the heating means and the recirculating means. Also, the treatment vessel may be an impregnation vessel, comprising a first interior, vessel with an inlet and separator at its bottom and an open top, and a second exterior vessel in communication with the open top of the first vessel and having an outlet at its bottom.

The invention further contemplates another method for treating comminuted cellulosic fibrous material to produce kraft pulp, comprising the steps of: Steaming the material in a steaming vessel. Treating the material in a generally upright treatment vessel operatively connected to the steaming vessel. Cooking the material, at a cooking temperature, to produce kraft pulp in an upright continuous digester, operatively connected to the treatment vessel, the digester having a material inlet at the top thereof, and a material outlet at the bottom thereof. Withdrawing black liquor from the digester into a withdrawal conduit through withdrawal screen means located at an intermediate portion of the digester, between the inlet and outlet thereof. Heating the withdrawn black liquor in the withdrawal means above the cooking temperature. Recirculating the heated withdrawn black liquor to the treatment vessel at a first point thereof; and withdrawing black liquor from the treatment vessel at a second point thereof, vertically spaced from the first point.

It is the primary object of the present invention to provide a method of producing kraft pulp with low kappa number, while producing low viscosity black liquor for subsequent recovery or disposal. This and other objects of the invention will become clear from a detailed inspection of the invention, and from the appended claims.

DETAILED DESCRIPTION OF THE DRAWING

Figure 1:
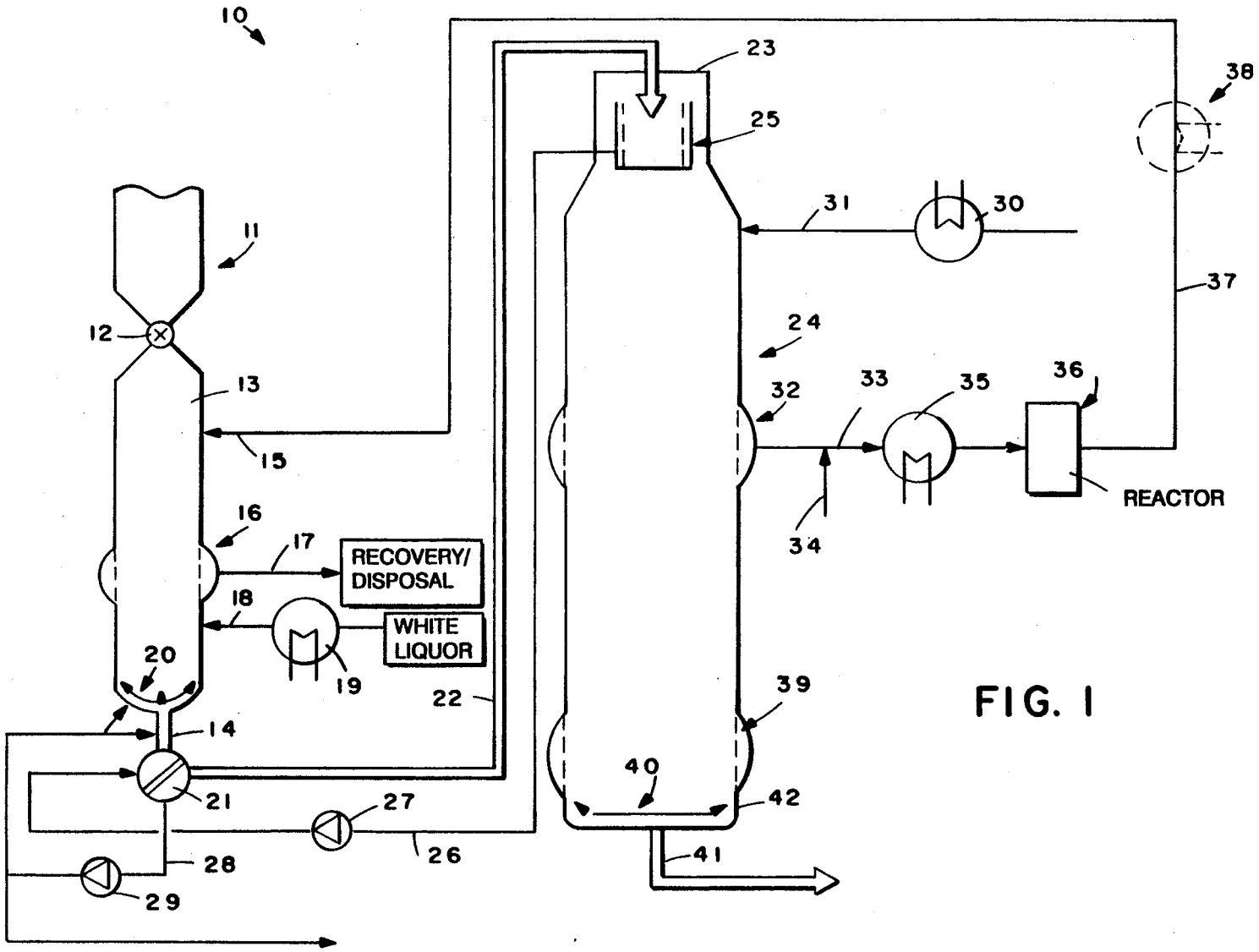
FIG. 1 is a schematic view of exemplary apparatus for practicing a method of treating comminuted cellulosic fibrous material according to the present invention.

Exemplary apparatus according to the present invention, and for practicing the method according to the present invention, is illustrated generally by reference numeral 10 in FIG. 1. The apparatus includes a conventional steaming vessel 11, in which wood chips—or like comminuted cellulosic fibrous material—may be steamed at a temperature greater than 100 degrees C. The bottom of the steaming vessel 11 is connected to a conventional low pressure feeder 12, which is connected to the top of a generally upright treatment vessel 13. The temperature in the vessel 13 is typically maintained at about 120–180 degrees C. A pulp conduit 14 extends from the bottom of the vessel 13, while a liquid introduction conduit 15 introduces liquor—black liquor—at a relatively high, first, point.

A conventional withdrawal screen system 16 is provided at a midpoint of the vessel 13, below conduit 15, with the withdrawal conduit 17 extending therefrom leading to a black liquor recovery or disposal stage. Another—white liquor—liquid introduction conduit 18, which preferably has a heater 19 associated therewith, is optionally provided to introduce white liquor into the vessel 13 after the black liquor is removed with screen system 16. A conventional rotating scraper 20 is provided at the bottom of the vessel 13 to facilitate discharge of the material into conduit 14.

From the conduit 14, the material is fed into the low pressure side of a conventional Kamyr ® high pressure feeder 21, the high pressure outlet line 22 thereof connected to the top 23 of a conventional continuous upright digester 24. A conventional liquid/material separator system 25 is provided at the top of digester 24, with withdrawn liquid recirculated in line 26, under the influence of pump 27, to the inlet high pressure port of the feeder 21. Liquid from the low pressure outlet port of the feeder 21 may be recirculated in line 28—under the influence of pump 29—to the conduit 14, and/or into the bottom of the vessel 13.

Instead of, or in addition to, adding white liquor in line 18, it may be added—after passage through heater 30—by line 31 adjacent the top of the digester 24. The white liquor that is added to the material is at cooking temperature, typically about 170 degrees C., although the temperature can vary depending upon the exact material being treated, and chemicals used to make up the white liquor.

As is conventional, black liquor is withdrawn from a mid level of the digester 24, as with the screen system 32, into a withdrawal conduit 33. According to the invention, alkali may be added to the withdrawn black liquor at line 34, either prior to, or in, heater 35. Heater 35 indirectly heats the black liquor to a temperature over cooking temperature. For example, the heater 35 may heat the black liquor to a temperature about 20–40 degrees C. above cooking temperature e.g. about 200 degrees C. when the cooking temperature is about 170 degrees C.). At this higher temperature, its viscosity is significantly reduced, and sulphur compounds will separate from it, and will react with the material in vessel 13 when exposed to it.

After the black liquor in conduit 33 is heated, it may be fed to a reaction vessel 36, where it is maintained at elevated temperature for sufficient time to insure the desired viscosity reduction. Of course the black liquor is maintained at high temperature in vessel 13 too prior to its extraction, so that it is maintained at high temperature for a long period of time. From vessel 36 it passes through a recirculation means, which includes line 37 (and may include a pump, or the like, if necessary) to the black liquor inlet 15 in the vessel 13. A heat exchanger 38 may optionally be provided in line 37 to precisely control the black liquor temperatures, if necessary.

As is conventional, the pulp at the bottom of the digester 24 is washed, screen system 39 providing for conventional wash liquid recirculation, and is ultimately discharged into line 41 at the bottom 42 of the digester 24. A conventional scraper 40 may facilitate the discharge.

The invention is practiced so that the kappa number of the pulp discharged in line 41 is low, e.g. below 20. At the same time, the black liquor withdrawn in conduit 17 and passed to disposal or recovery has a low viscosity, lower than that of the black liquor in line 33.

Utilizing the apparatus heretofore described, an exemplary method according to the invention may be practiced, which includes the following steps:

(a) Steaming the comminuted cellulosic fibrous material in the steaming vessel 11.

(b) Adding white liquor to the steamed material, with line 17 and/or line 31. The white liquor is preferably at cooking temperature (e.g. about 170 degrees C.).

(c) Cooking the material, with white liquor, in the continuous digester 24 at a cooking temperature (e.g. about 170 degrees C.).

(d) Extracting black liquor from the continuous digester 24 with the screen system 32, into conduit 33.

(e) Heating the extracted black liquor above the cooking temperature (e.g. to about 20–40 degrees C. over cooking temperature; such as to 200 degrees C.) with the heater 35; alkali addition, from line 34, may optionally be provided prior to or simultaneously with heating.

(f) Adding the heated black liquor from step (e) to the steamed material between steps (a) and (b), by passing it through recirculation line 37 to introduction line 15, adjacent the top of treatment vessel 35.

And, (g) withdrawing the black liquor from the material between steps (f) and (b), using screen system 16. The withdrawn black liquor in conduit 17 is passed to disposal or recovery, and has reduced viscosity compared to the black liquor when withdrawn at 32.

The method may also comprise the further step (h), between steps (e) and (f), of maintaining the material at above cooking temperature a time sufficient to insure significant reduction of the viscosity thereof, e.g. in reaction vessel 36.

Figure 2:
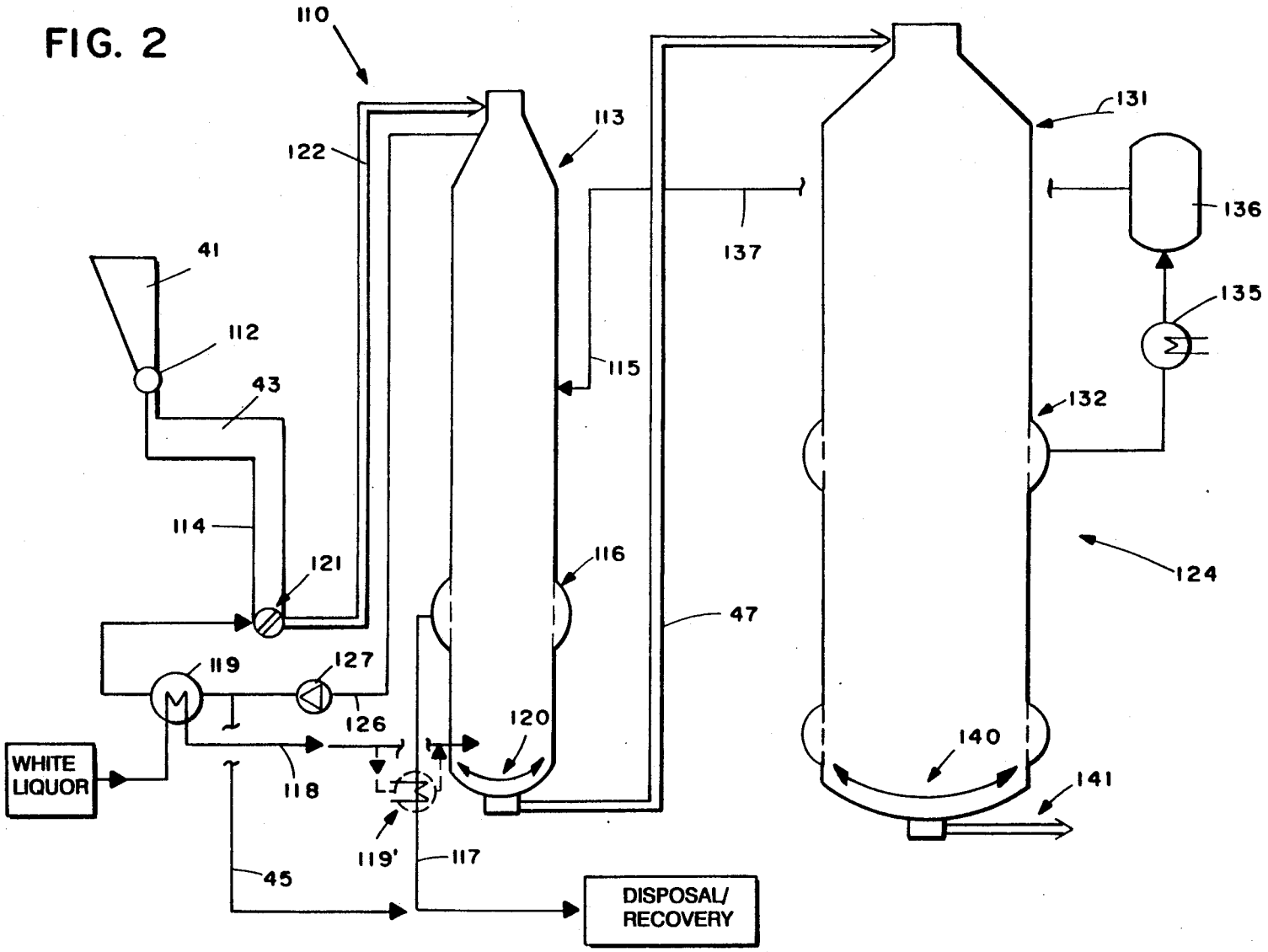
FIG. 2 is a view like that of FIG. 1 illustrating a second embodiment of exemplary apparatus for practicing a method according to the invention.

FIG. 2 illustrates a second embodiment of apparatus according to the invention, useful for practicing a method according to the invention. In the apparatus of FIG. 2 components having the same function as like components in the FIG. 1 embodiment are indicated by the same reference numeral only preceded by a "1".

The major distinctions of the FIG. 2 embodiment over the FIG. 1 embodiment are the utilization of a more conventional feeding arrangement to the treatment (impregnation) vessel 113, and the utilization of a white liquor heat exchanger 119 to also cool recirculating liquor liquid prior it being fed to the high pressure feeder so as to minimize adverse effects thereon.

In the FIG. 2 embodiment, the apparatus 110 includes a conventional chips bin 41 connected by a conventional low pressure feeder 112 to a conventional horizontal steaming vessel 43, which in turn is connected by a conventional chute 114 to the conventional high pressure feeder 121. Material entrained in liquid passes in line 122 to the top of the impregnation vessel 113, while withdrawn liquid, separated in a conventional top separator (not shown) in the impregnation vessel 113, is returned by recirculating line 126 in pump 127 to the high pressure feeder 121. In order to reduce the temperature of the recirculating liquid so as to minimize the possible adverse effects on the high pressure feeder 121, while at the same time preheating the white liquor, the white liquor is passed through the heat exchanger 119 in the line 126 (prior to the high pressure feeder 121), and then is introduced in the line 118 adjacent the bottom of the impregnation vessel 113. If desired, the white liquor could also, or alternatively, be heated in the heat exchanger 119', which is in the withdrawal line 117 for black liquor from the withdrawal screen system 116 of impregnation vessel 113. In the FIG. 2 embodiment, there also preferably is provided another line 45 which withdraws some of the black liquor that is recirculating in the line 126, passing it, also, to disposal or recovery.

Figure 3:
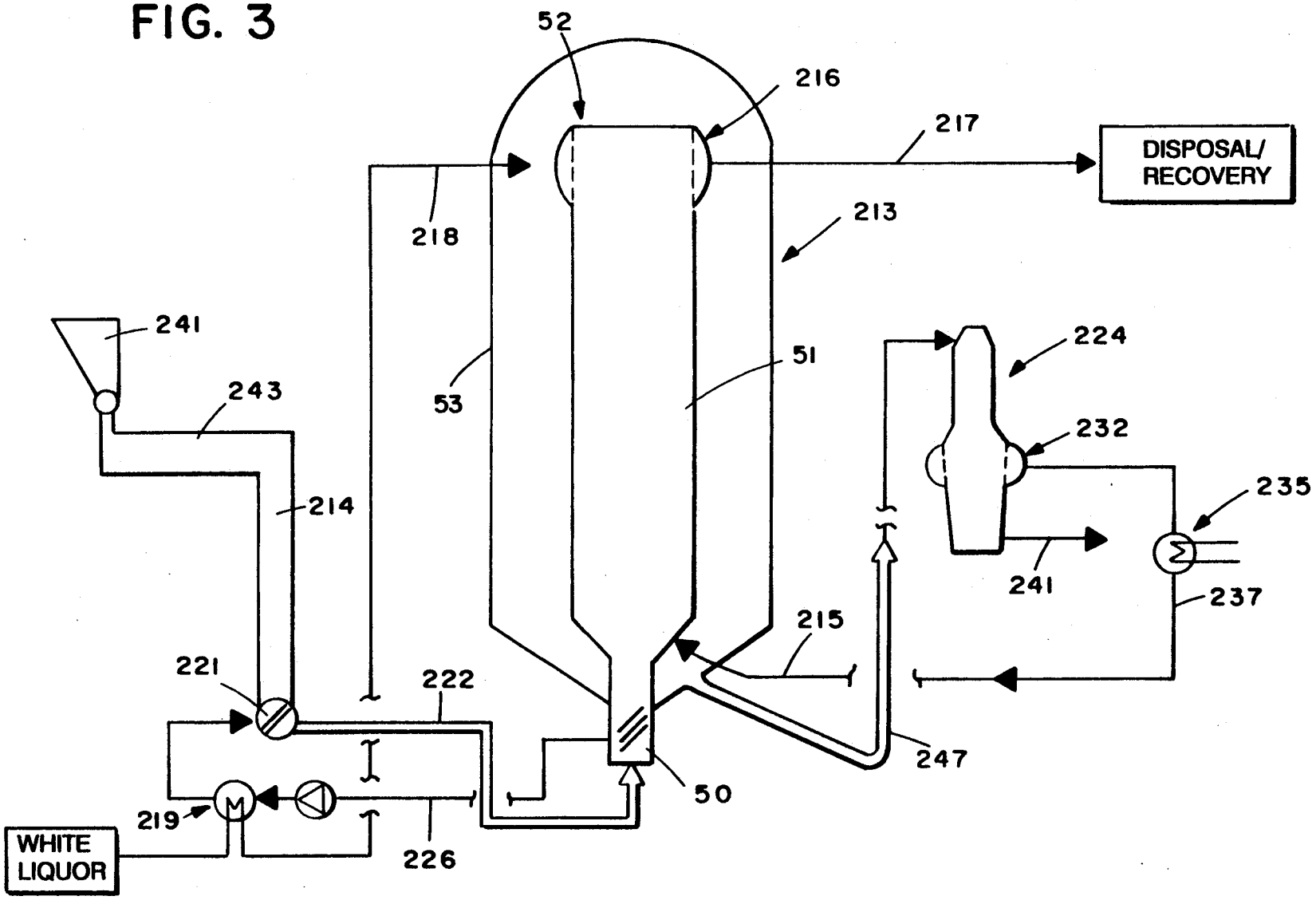
FIG. 3 is a view like that of FIGS. 1 and 2 of a third embodiment.

The apparatus illustrated schematically in FIG. 3 is similar to that illustrated in FIG. 2 except for the configuration of the impregnation vessel. In the FIG. 3 embodiment the structure comparable to those in the FIG. 2 embodiment are indicated by the same two digit reference number preceded by a "2".

In the FIG. 3 embodiment, the impregnation vessel 213 comprises a liquid/material separator 50 (having the same design as a conventional "top separator") at the bottom of a first interior, vessel 51, which has an open top 52. The black liquor withdrawal screens 216 are provided at (just below) the open top 52. Surrounding the first, interior, vessel 51 is a second, exterior vessel 53 which has the outlet 247 for the impregnated material adjacent the bottom thereof (near the inlet/separator 50 for the interior vessel 51). White liquor—which preferably has been preheated in the heat exchanger 219 disposed in the line 226 of withdrawal liquor from the separator 50—is introduced into the second vessel 53 at the top thereof, just below the open top 52 of the interior vessel 51. The heated black liquor is introduced in line 215 adjacent the bottom of the first vessel 51 (just above the separator 50).

While it is preferred for heat economy and space considerations that the vessels 51, 53, be concentric, and one disposed within the other, if desired the vessel 53 can be a distinct vessel operatively connected to the top 52 of the first vessel 51 by a conduit or the like.

Any of the systems illustrated in FIGS. 1 through 3 may be utilized to effectively practice the method according to the invention.

It will thus be seen that according to the present invention, a method and apparatus have been provided which produce kraft pulp with a low kappa number (below 20), and the black liquor that results has a lower viscosity than is conventional.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of producing kraft pulp from comminuted cellulosic fibrous material, using a continuous digester, comprising the steps of continuously:

(a) steaming the comminuted cellulosic fibrous material in a steaming vessel;

(b) adding white liquor to the steamed material in a generally upright treatment vessel;

(c) cooking the material, with white liquor, in the continuous digester at a cooking temperature;

(d) extracting black liquor from the continuous digester;

(e) heating the extracted black liquor above the cooking temperature to cause sulphur compounds to separate from the black liquor and be available for reaction with the steamed material in the treatment vessel;

(f) adding the heated black liquor from step (e) to the steamed material between steps (a) and (b), so that the sulphur compounds separated from the black liquor react with the steamed material in the treatment vessel; and (g) withdrawing the black liquor from the material between steps (f) and (b).

2. A method as recited in claim 1 wherein step (e) is practiced to heat the black liquor to a temperature of about 20–40 degrees C. over cooking temperature.

3. A method as recited in claim 2 comprising the further step (i) of passing the black liquor removed in step (g) to recovery or disposal, and wherein steps (a)–(g) and (i) are practiced so that the black liquor in step (i) has a lower viscosity than the black liquor withdrawn from the continuous digester in step (d).

4. A method as recited in claim 2 wherein step (f) is practiced by passing some of the black liquor countercurrently to the flow of the steamed material.

5. A method as recited in claim 4 comprising the further step (j) of adding alkali to the black liquor withdrawn in step (d), and prior to or simultaneously with the practice of step (e).

6. A method as recited in claim 1 wherein step (c) is practiced at a temperature of approximately 170 degrees C., and step (e) is practiced to heat the black liquor to a temperature of about 200 degrees C.

7. A method as recited in claim 6 comprising the further step (h), between steps (e) and (f), of maintaining the material at above cooking temperature a time sufficient to insure significant reduction of the viscosity thereof.

8. A method as recited in claim 7 comprising the further step (i) of passing the black liquor removed in step (g) to recovery or disposal.

9. A method as recited in claim 8 wherein steps (a)–(i) are practiced so that the black liquor in step (i) has a significantly lower viscosity than the black liquor withdrawn from the continuous digester in step (d).

10. A method as recited in claim 9 comprising the further step (j) of adding alkali to the black liquor withdrawn in step (d), and prior to or simultaneously with the practice of step (e).

11. A method as recited in claim 1 wherein steps (f) and (g) are practiced in a generally upright treatment vessel operatively connected at the top thereof to a low pressure feeder, and at the bottom thereof to a high pressure feeder; and wherein step (b) is practiced by adding white liquor to both the treatment vessel and to the continuous digester.

12. A method as recited in claim 1 wherein steps (b), (f) and (g) are practiced in an upright impregnation vessel, and wherein step (a) is practiced in a steaming vessel, distinct from said upright impregnation vessel, and comprising the further steps of: withdrawing liquid from the impregnation vessel and recirculating it to entrain material from the steaming vessel with the withdrawn liquid; feeding the entrained material to the impregnation vessel with a high pressure feeder; and passing the white liquor to be added in step (b) into heat exchange contact with the withdrawn, recirculating, liquid prior to passage thereof to the high pressure feeder, so as to reduce the temperature of the recirculating liquid, and increase the temperature of the white liquor.

13. A method as recited in claim 12 wherein the impregnation vessel comprises a first, interior, vessel having an inlet at the bottom thereof, and an open top, and a second, exterior, vessel in communication with the open top of the first vessel, and having an outlet at the bottom thereof; and wherein step (f) is practiced by adding heated black liquor adjacent the inlet to the first vessel, and wherein step (g) is practiced adjacent the open top of the first vessel, and wherein step (b) is practiced adjacent the top of the second vessel, where the first vessel overflows into the second vessel, and also by adding white liquor to the digester.

14. A method as recited in claim 1 wherein steps (a)–(g) are practiced to produce a kraft pulp having a kappa number below 20.

15. A method as recited in claim 1 wherein steps (f) and (g) are practiced in a generally upright treatment vessel operatively connected at the bottom thereof to a high pressure feeder; and wherein step (b) is practiced by adding white liquor to both the treatment vessel and to the continuous digester.

16. A method as recited in claim 1 comprising the further step (j) of adding alkali to the black liquor withdrawn in step (d), and prior to or simultaneously with the practice of step (e).

17. A method as recited in claim 16 wherein step (f) is practiced by passing some of the black liquor countercurrently to the flow of the steamed material.

18. A method as recited in claim 1 wherein step (f) is practiced by passing some of the black liquor countercurrently to the flow of the steamed material.

19. A method for treatment comminuted cellulosic fibrous material to produce kraft pulp, comprising the steps of:

steaming the material in a steaming vessel;

treating the material in a generally upright treatment vessel operatively connected to the steaming vessel;

cooking the material, at a cooking temperature, to produce kraft pulp in an upright continuous digester, operatively connected to the treatment vessel, the digester having a material inlet at the top thereof, and a material outlet at the bottom thereof;

withdrawing black liquor from the digester into a withdrawal conduit through withdrawal screen means located at an intermediate portion of the digester, between the inlet and outlet thereof;

heating the withdrawn black liquor in the withdrawal means above the cooking temperature to cause sulphur compounds to separate from the black liquor and be available for reaction with the steamed material;

recirculating the heated withdrawn black liquor to the treatment vessel at a first point thereof, so that the sulphur compounds separated from the black liquor react with the steamed material; and withdrawing black liquor from the treatment vessel at a second point thereof, vertically spaced from the first point.

20. A method as recited in claim 19 comprising the further step of adding white liquor to the material in the treatment vessel at a third point thereof, closer to the digester than the second point.

21. A method as recited in claim 20 comprising the further steps of: withdrawing liquid from the treatment vessel and recirculating it to entrain material from the steaming vessel with the withdrawn liquid; feeding the entrained material to the treatment vessel with a high pressure feeder; and passing the white liquor to be added into heat exchange contact with the withdrawn, recirculating, liquid prior to passage thereof to the high pressure feeder, so as to reduce the temperature of the recirculating liquid, and increase the temperature of the white liquor.

22. A method as recited in claim 21 wherein the treatment vessel comprises a first, interior, vessel having an inlet at the bottom thereof, and an open top and a second, exterior, vessel in communication with the open top of the first vessel, and having an outlet at the bottom thereof; and wherein heated black liquor is added adjacent the inlet to the first vessel, and wherein the black liquor is withdrawn from the treatment vessel adjacent the open top of the first vessel, and wherein the white liquor is added adjacent the top of the second vessel, where the first vessel overflows into the second vessel, and wherein white liquor is also added to the digester.

23. A method as recited in claim 22 wherein said heating step is practiced by heating the black liquor to a temperature of about 20–40 degrees C. over cooking temperature, and comprising the further step of maintaining the material at above cooking temperature a time sufficient to insure significant reduction of the viscosity thereof.

24. A method as recited in claim 19 comprising the further step of adding alkali to the withdrawn black liquor in the withdrawal conduit prior to or simultaneously with heating thereof.

25. A method as recited in claim 24 wherein the step of recirculating the heated withdrawn black liquor to the treatment vessel is practiced so that some of the black liquor moves countercurrently to the flow of steamed material in the treatment vessel, black liquor being removed from the top of the treatment vessel and being passed to recovery or disposal.

26. A method as recited in claim 25 wherein said heating step if practiced by heating the black liquor to a temperature of about 20°–40° C. over cooking temperature, and comprising the further step of maintaining the material at above cooking temperature a time sufficient to insure significant reduction of the viscosity thereof.

27. A method as recited in claim 19 wherein said heating step is practiced by heating the black liquor to a temperature of about 20–40 degrees C. over cooking temperature, and comprising the further step of maintaining the material at above cooking temperature a time sufficient to insure significant reduction of the viscosity thereof.

28. A method as recited in claim 27 wherein the step of recirculating the heated withdrawn black liquor to the treatment vessel is practiced so that some of the black liquor moves countercurrently to the flow of steamed material in the treatment vessel, black liquor being removed from the top of the treatment vessel and being passed to recovery or disposal.

29. A method as recited in claim 19 wherein the step of recirculating the heated withdrawn black liquor to the treatment vessel is practiced so that some of the black liquor moves countercurrently to the flow of steamed material in the treatment vessel, black liquor being removed from the top of the treatment vessel and being passed to recovery or disposal.

* * * * *